US007467624B2

(12) United States Patent
An

(10) Patent No.: US 7,467,624 B2
(45) Date of Patent: Dec. 23, 2008

(54) EXHAUST GAS RECIRCULATION SYSTEM

(75) Inventor: Kil Hyun An, Incheon (KR)

(73) Assignee: Hyundai Motor Company, Seoul (KR)

( * ) Notice: Subject to any disclaimer, the term of this patent is extended or adjusted under 35 U.S.C. 154(b) by 54 days.

(21) Appl. No.: 11/591,772

(22) Filed: Nov. 2, 2006

(65) Prior Publication Data

US 2008/0035126 A1 Feb. 14, 2008

(30) Foreign Application Priority Data

Aug. 10, 2006 (KR) ..... 10-2006-0075644

(51) Int. Cl.
*F02M 25/07* (2006.01)
*F02B 47/08* (2006.01)

(52) U.S. Cl. ..... 123/568.13; 123/568.11

(58) Field of Classification Search ..... 123/568.11, 123/568.12, 568.13, 568.17, 568.18
See application file for complete search history.

(56) References Cited

U.S. PATENT DOCUMENTS 3,937,194 A * 2/1976 Tamaki et al. ..... 123/568.13
4,328,781 A * 5/1982 Morita ..... 123/568.12
4,422,430 A * 12/1983 Wiatrak ..... 123/568.13
4,643,157 A * 2/1987 Nishikawa et al. ..... 123/568.13
4,672,939 A * 6/1987 Yokoi et al. ..... 123/568.17
4,854,291 A * 8/1989 Elsbett et al. ..... 123/568.13
5,351,668 A * 10/1994 Gatellier ..... 123/568.13
6,470,865 B2 * 10/2002 Iizuka et al. ..... 123/568.13
6,895,948 B2 * 5/2005 Mori et al. ..... 123/568.17
7,059,310 B2 * 6/2006 Altenschmidt et al. . 123/568.18

* cited by examiner

*Primary Examiner*—Willis R Wolfe, Jr.
(74) *Attorney, Agent, or Firm*—Morgan, Lewis & Bockius LLP

(57) ABSTRACT

To prevent inflow of condensed water to an exhaust gas recirculation (EGR) valve, an exhaust gas recirculation system includes a first gas passage, an exhaust gas recirculation valve connected to the first gas passage and selectively opening/closing the first gas passage, an exhaust gas passage disposed in the exhaust gas recirculation valve, and a second gas passage connecting the exhaust gas passage to an air-fuel mixture passage. The exhaust gas passage is tilted at an obtuse angle with respect to the second gas passage. The angle may be less than about 170°, and in some embodiments the angle is about 165°.

3 Claims, 1 Drawing Sheet

EXHAUST GAS RECIRCULATION SYSTEM

CROSS-REFERENCE TO RELATED APPLICATION

This application claims priority to and the benefit of Korean Patent Application No. 10-2006-0075644 filed in the Korean Intellectual Property Office on Aug. 10, 2006, the entire contents of which are incorporated herein by reference.

BACKGROUND OF THE INVENTION

1. Field of the Invention

The present invention relates to an exhaust gas recirculation (EGR) system. More particularly, the present invention relates to an EGR system for preventing condensed water from exhaust gas from inflowing to an EGR valve.

2. Description of the Related Art

Generally, an EGR system reduces nitrogen oxides in exhaust gas. A conventional EGR system includes an exhaust gas passage mounted to a cylinder head and an EGR valve disposed at an exhaust manifold or the exhaust gas passage. The EGR valve opens/closes the exhaust gas passage to selectively transmit exhaust gas to a combustion chamber.

However, condensed water from the exhaust gas inflows to the EGR valve after the engine stops. If condensed water inflows to the EGR valve in winter, the EGR valve does not operate or freezes up. Furthermore, if a vehicle is parked for a long time, because corrosion occurs in the EGR valve due to the condensed water, malfunction of the EGR valve may occur.

In addition, if the EGR valve does not operate due to being frozen, fuel consumption and exhaust gas characteristics are deteriorated when the vehicle starts.

The above information disclosed in this background section is only for enhancement of understanding of the background of the invention and therefore it may contain information that does not form the prior art that is already known in this country to a person of ordinary skill in the art.

SUMMARY OF THE INVENTION

The present invention provides an exhaust gas recirculation (EGR) system that prevents inflow of condensed water to the EGR valve.

An exemplary embodiment of the present invention provides an exhaust gas recirculation system including a first gas passage, an exhaust gas recirculation valve connected to the first gas passage and selectively opening/closing the first gas passage, an exhaust gas passage disposed in the exhaust gas recirculation valve, and a second gas passage connecting the exhaust gas passage to an air-fuel mixture passage. The exhaust gas passage is tilted at an obtuse angle with respect to the second gas passage. The angle may be less than about 170°, and in some embodiments the angle is about 165°.

DETAILED DESCRIPTION OF THE PREFERRED EMBODIMENTS

Figure 1:
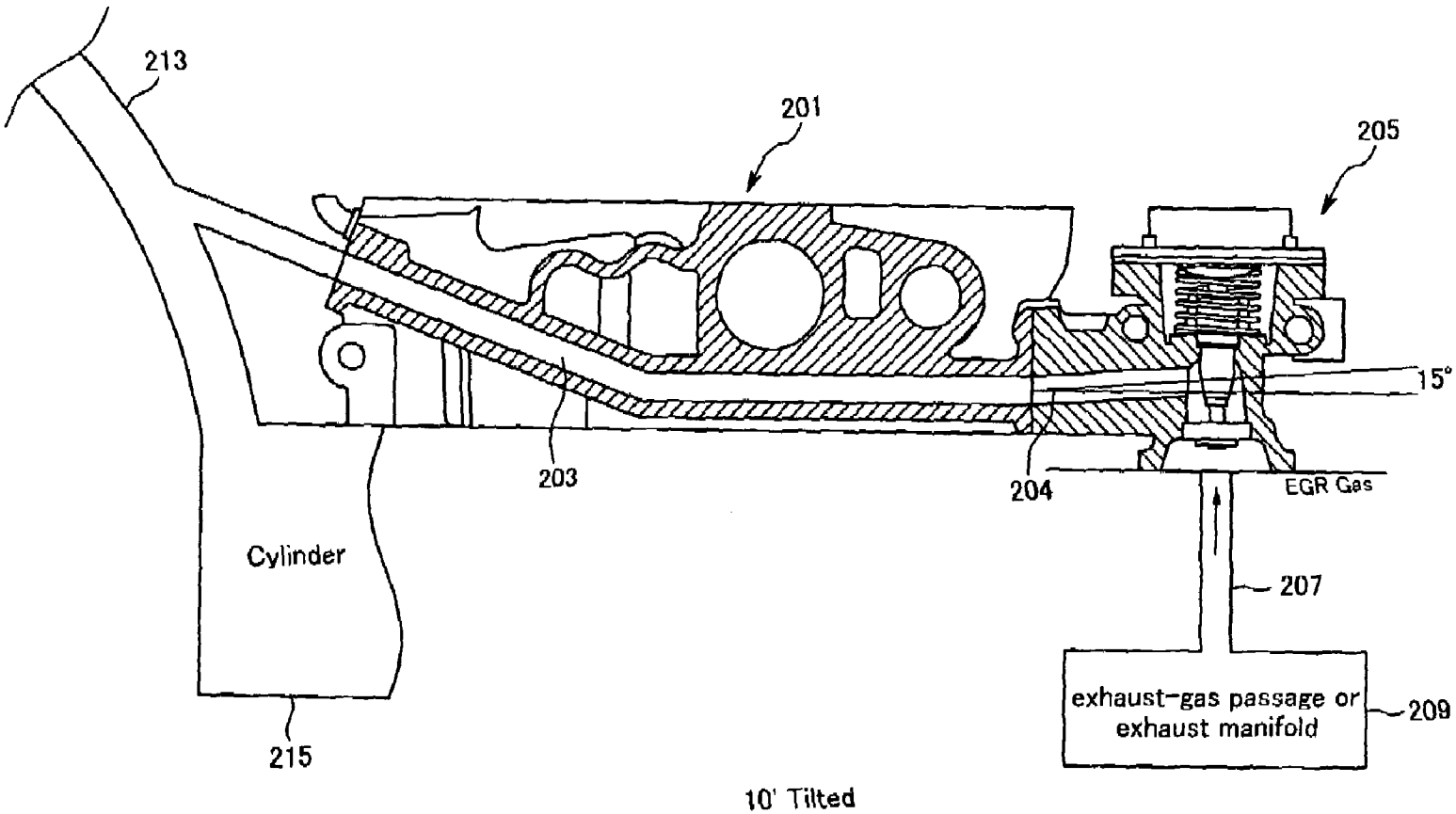
FIG. 1 shows an EGR system according to an exemplary embodiment of the present invention.

An exemplary embodiment of the present invention will hereinafter be described in detail with reference to the accompanying drawing.

According to an exemplary embodiment of the present invention, a first gas passage 207 transmits some of the exhaust gas from an exhaust manifold 209. An EGR valve 205 is connected to the first gas passage 207 and selectively opens/closes the first gas passage 207.

A second gas passage 203 is mounted to a cylinder head 201 and connects the EGR valve 205 to an air-fuel mixture passage 213 such that the exhaust gas inflows from the EGR valve 205 to a combustion chamber 215, and the exhaust gas passage 204 of the EGR valve is bent at a predetermined angle with respect to the second gas passage 203 such that inflow of condensed water from the exhaust gas is prevented.

The exhaust gas flows from the exhaust gas passage or exhaust manifold 209 to the EGR valve 205 through the first gas passage 207. The EGR valve 205 is opened/closed by an engine control unit (not shown), which may include a processor, memory, and associated hardware, software, and/or firmware as may be selected and programmed by a person of ordinary skill in the art based on the teachings of the present invention.

The exhaust gas sequentially passes through the exhaust gas passage 204 of the EGR valve 205 and the second exhaust gas passage 203. The exhaust gas is mixed with the air-fuel mixture in the air-fuel mixture passage 213 and flows to the combustion chamber 215.

In some embodiments, the exhaust gas passage 204 of the EGR valve 205 is bent at an obtuse angle of less than 170° with respect to the second exhaust gas passage 203, and in some embodiments, it is bent at 165°. However, the angle may be chosen based on tilt angle when the engine is mounted to an engine compartment, by exhaust amount of the vehicle, or by the size of the engine. Due to this bend, condensed water cannot inflow to the EGR valve 205.

If the engine stops at low temperatures, such as in winter, the condensed water may be frozen in the second exhaust gas passage 203. However, in this case, when the engine starts, the frozen water evaporates by the inflow of the exhaust gas, which is generally over 500° C.

Therefore, according to an exemplary embodiment of the present invention, the inflow of condensed water to the EGR valve 205 is prevented, freezing of the condensed water in the EGR valve 205 is prevented, and ice in the second exhaust gas passage 203 is prevented from inflowing to the combustion chamber 215.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An exhaust gas recirculation system, comprising:

a first gas passage;

an exhaust gas recirculation valve connected to the first gas passage and selectively opening/closing the first gas passage;

an exhaust gas passage disposed inside the exhaust gas recirculation valve; and a second gas passage connecting the exhaust gas passage to an air-fuel mixture passage outside of exhaust gas recirculation valve;

wherein the exhaust gas passage is tilted at an obtuse angle with respect to the second gas passage.

2. The system of claim 1, wherein the angle is less than about 170°.

3. The system of claim 2, wherein the angle is about 165°.

* * * * *